US008616795B2

(12) United States Patent
Luisi et al.

(10) Patent No.: US 8,616,795 B2
(45) Date of Patent: Dec. 31, 2013

(54) TOOL FOR OPERATING ON A THREE-DIMENSIONAL SURFACE

(75) Inventors: Jerold N. Luisi, Phoenix, AZ (US); Timothy R. Littlefield, Phoenix, AZ (US); Jeanne K. Pomatto-Hertz, Scottsdale, AZ (US)

(73) Assignee: Cranial Technologies, Inc., Tempe, AZ (US)

( * ) Notice: Subject to any disclaimer, the term of this patent is extended or adjusted under 35 U.S.C. 154(b) by 526 days.

(21) Appl. No.: 12/930,078

(22) Filed: Dec. 27, 2010

(65) Prior Publication Data

US 2012/0163901 A1 Jun. 28, 2012

(51) Int. Cl.
*B43K 21/22* (2006.01)

(52) U.S. Cl.
USPC ..... 401/93; 401/92

(58) Field of Classification Search
USPC ..... 401/92–94, 88, 49
See application file for complete search history.

(56) References Cited

U.S. PATENT DOCUMENTS 4,627,756 A * 12/1986 Kageyama ..... 401/94
5,171,097 A * 12/1992 Nagaoka et al. ..... 401/65
7,237,972 B2 * 7/2007 Kanari et al. ..... 401/92

* cited by examiner

*Primary Examiner* — David Walczak
(74) *Attorney, Agent, or Firm* — Donald J Lenkszus

(57) ABSTRACT

A tool for depositing material onto a three-dimensional surface comprises a first tubular member comprising a first guide surface and a second guide surface. The tool further comprises a second tubular member comprising a first guide surface engaging the first tubular member first surface and comprising a second guide surface engaging the first tubular member second surface. A first resilient member is disposed to urge the second tubular member in a first axial direction relative to the first tubular member. A tubular material holder is disposed axially within the second tubular member. A second resilient member is disposed in the tool to urge the holder in a second axial direction opposite to said first axial direction.

26 Claims, 5 Drawing Sheets

TOOL FOR OPERATING ON A THREE-DIMENSIONAL SURFACE

FIELD OF THE INVENTION

The invention pertains to a tool for operating on three-dimensional surfaces, in general, and a tool to mark lines in the manufacture of cranial remodeling devices, in particular.

BACKGROUND OF THE INVENTION

Cranial remodeling is utilized to correct for deformities in the head shapes of infants. Prior to the development of the Dynamic Orthotic Cranioplasty$^{SM}$ method of cranial remodeling by Cranial Technologies, Inc, the assignee of the present invention, the only viable approach for correction of cranial deformities was surgical correction of the shape of the cranium. Dynamic Orthotic Cranioplasty$^{SM}$ utilizes a treatment protocol in which the DOC BAND® cranial remodeling device is custom produced for each subject to be treated.

In the past, custom cranial remodeling devices were produced by first obtaining a full size and accurate cast of the actual head shape of each subject. This cast was then modified to produce a second or desired head shape model. The second or desired head shape model is used to form the cranial remodeling band for the infant. In the past, the second or desired shaped head shape model was obtained by manually modifying the first cast to form the desired shape model.

Cranial Technologies has maintained a "library" of the casts of the head casts of infant's deformed heads and the corresponding models of the desired corrected head shapes.

Cranial Technologies, Inc. continued its pioneering developments with its proprietary DSI® digital image capturing system and its Digital Surface Imaging®methodology for the time efficient and safe image capture of three-dimensional full head images.

More specifically, the DSI® digital image capturing system was utilized to capture DSI® digital data representative of digital images of each cast of a deformed head and each corresponding model of the corrected head shape and store the DSI® digital data for each digital image in first and second databases, respectively. The first and second databases were utilized to train a neural network.

In its continuing efforts, Cranial Technologies further developed a system that utilized these first and second databases to automatically produce digital data representative of a modified head shape from DSI® digital data representative of a deformed head.

The data representative of the deformed head is utilized to provide a full size replica of the modified head shape. On that full size replica, a polymer plastic material is formed as a step in the production of a custom DOC BAND® cranial remodeling device.

After the polymer plastic material is formed on the full size replica, the polymer plastic material must be cut as step in forming a final DOC BAND® cranial remodeling device. The cutting of the material is along trim lines that are customized for the specific customized DOC BAND® cranial remodeling device.

Cranial Technologies further developed a methodology and a computer program implementing that methodology to generate corresponding trim lines for each customized DOC BAND® cranial remodeling device. That methodology is the subject of prior patents owned by Cranial Technologies, Inc.

With the methodology and computer program it is possible for to use a Computer Numerical Control (CNC) machine cutting tool to directly cut the shape of the cranial remodeling device in the polymer plastic material utilizing the computer generated trim line.

Although it is possible to automatically cut along the computer system generated trim lines, we have determined that it is desirable to first draw or mark the trim lines on the polymer plastic surface. Drawing the trim lines allows a product finisher to use skilled judgment to adjust the trim lines as necessary in finishing the product.

We discovered that there is considerable difficulty in drawing or marking the trim lines on the complex three-dimensional surface of a cranial remodeling device. Although CNC machines are particularly useful when cutting a complex three-dimensional bodies, it is difficult to program a tool to just contact the surface of a complex three-dimensional surface with perfect accuracy to provide trim line markings on the surface. The problem is especially aggravated where the surface being marked is a plastic surface. When the plastic surface is digitized, the inherent noise that occurs in the digitization appears as surface variations to the CNC machine We tried to find a marking tool usable in a CNC machine that could be used to draw trim lines as part of our manufacturing process. We found commercially available rigid drawing or marking tools that are suitable for use in CNC machines. However, all of those marking tools require 100% accuracy in locating the surface. If the location of the surface is not perfectly located, the marking tool may impact the surface and break or damage the surface, or the marking tool may not actually touch the surface with the result that the trim line is not drawn, or the marking tool may when drawing the trim line damage the surface in portions, mark the surface in portions, and miss the surface in other portions.

Many commercially available marking tools were investigated for suitability in marking trim lines onto polymer plastic three-dimensional complex surfaces. None of the commercially available marking tools was effective. For these and other reasons, we determined that it was desirable to provide apparatus that would consistently and effectively drawing lines onto the complex surface of a three-dimensional object without risk of damage to the surface and without requiring perfect placement onto the surface.

SUMMARY

In one embodiment of the invention, a tool for depositing material onto a three-dimensional surface is provided. The tool comprises a first tubular member comprising a first guide surface and a second guide surface. The tool further comprises a second tubular member comprising a first guide surface engaging the first tubular member first surface and comprising a second guide surface engaging the first tubular member second surface. A first resilient member is disposed to urge the second tubular member in a first axial direction relative to the first tubular member. A material holder is disposed axially within the second tubular member. A second resilient member is disposed in the tool to urge the holder in a second axial direction opposite to said first axial direction.

In another embodiment, a tool for marking a three-dimensional surface is provided. The tool comprises a first tubular member adapted to be carried by a motive spindle of a machine of a type capable of moving said spindle along a plurality of axes. A second tubular member is in telescoping engagement with the first tubular member. A first resilient member urges the second tubular member in a first axial direction relative to the first tubular member. A tubular material holder is disposed axially within the second tubular member. A second resilient member urges the holder in a second axial direction opposite to the first axial direction such that the tubular material holder is retained within the tool.

In a further embodiment, apparatus for working a three-dimensional surface is provided. The tool comprises a first tubular member adapted to be carried by a motive spindle of a machine of a type capable of moving said spindle along a plurality of axes. A second tubular member is in telescoping engagement with the first tubular member. A first resilient member urges the second tubular member in a first axial direction relative to the first tubular member. A tool holder is disposed axially within the second tubular member. A second resilient member urges the holder in a second axial direction opposite to the first axial direction such that the tool is retained within the holder.

In another embodiment of the invention, a tool for depositing material onto a three-dimensional surface to mark trim lines for a cranial remodeling device is provided. The tool comprises a first tubular member adapted to be received in a spindle of a 5-axis computerized numeric control mill machine. The first tubular member comprises a first guide surface and a second guide surface. The tool further comprises a second tubular member comprising a first guide surface engaging the first tubular member first surface and comprising a second guide surface engaging the first tubular member second surface. A first resilient member is disposed to urge the second tubular member in a first axial direction relative to the first tubular member. A tubular material holder is disposed axially within the second tubular member. The tubular material holder is adapted to retain marking material therein and extending therefrom. A second resilient member is disposed in the tool to urge the holder in a second axial direction opposite to said first axial direction.

In yet a further embodiment, a tool for marking a three-dimensional surface is provided to mark trim lines onto the surface prior to cutting the surface to form a cranial remodeling device is provided. The tool comprises a first tubular member adapted to be carried by a motive spindle of a machine of a type capable of moving said spindle along a plurality of axes. A second tubular member is in telescoping engagement with the first tubular member. A first resilient member urges the second tubular member in a first axial direction relative to the first tubular member. A tubular material holder is disposed axially within the second tubular member. The tubular material holder is adapted to hold material for marking the surface A second resilient member urges the holder in a second axial direction opposite to the first axial direction such that the tubular material holder is retained within the tool.

In various embodiments of the invention, a graphite marking material is advantageously used in the marking tool to mark trim lines onto a polymer plastic surface

BRIEF DESCRIPTION OF THE DRAWING

The invention will be better understood from a reading of the following detailed description in conjunction with the drawing figures in which like reference designators identify like elements, and in which.

DETAILED DESCRIPTION

U.S. Pat. No. 7,127,101 issued Oct. 24, 2006; U.S. Pat. No. 7,142,701 issued Nov. 28, 2006; U.S. Pat. No. 7,162,075 issued Jan. 9, 2007; U.S. Pat. No. 7,177,461 issued Feb. 13, 2007; U.S. Pat. No. 7,227,979 issued Jun. 5, 2007; U.S. Pat. No. 7,242,798 issued Jul. 10, 2007; U.S. Pat. No. 7,245,743 issued Jul. 17, 2007; U.S. Pat. No. 7,280,682 issued Oct. 9, 2007; and U.S. Pat. No. 7,305,369 issued Dec. 4, 2007 are all assigned to Cranial Technologies, Inc., assignee of the present application, and the disclosures contained in each of the patents are expressly incorporated herein by reference.

The aforementioned Cranial Technologies Patents describe systems and methodologies to which the present invention is particularly well suited. In particular, U.S. Pat. No. 7,227,979 describes a methodology and system in which trim lines are generated for customized cranial remodeling devices and in which the trim lines are utilized to produce corresponding customized cranial remodeling devices.

Figure 1:
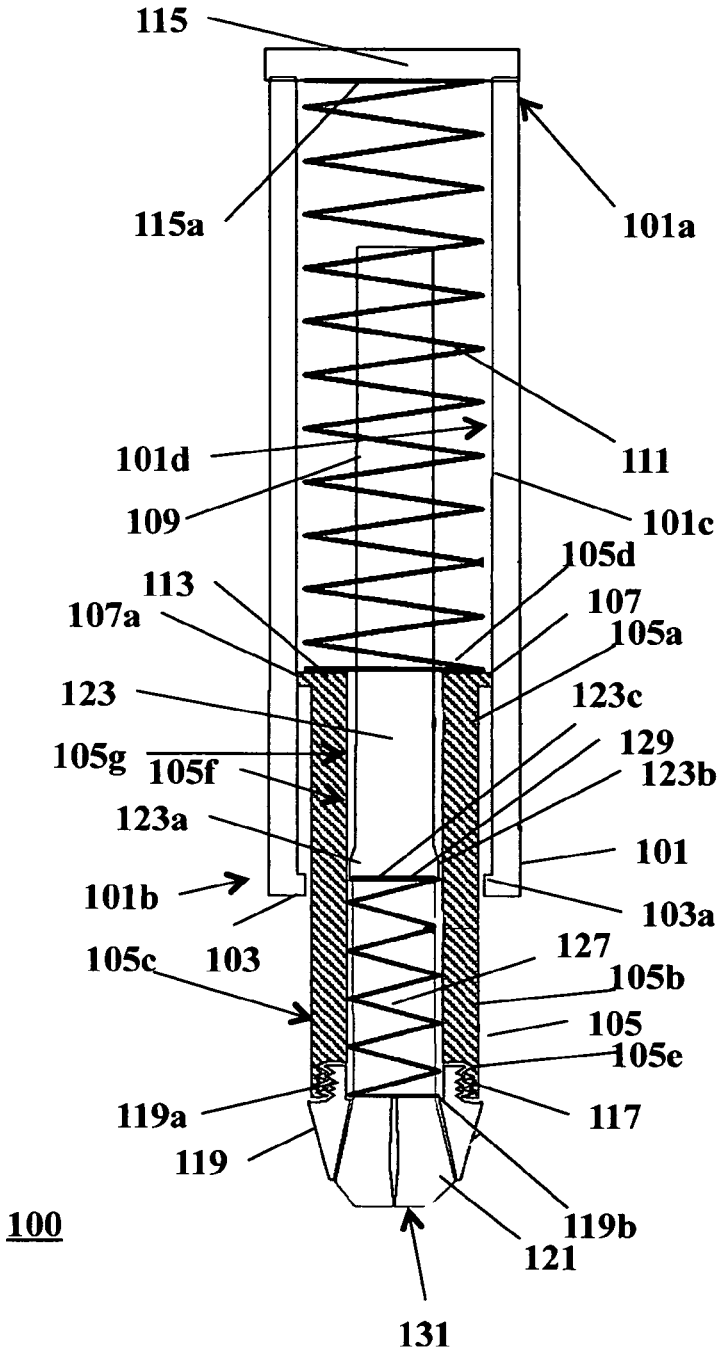
FIG. 1 illustrates an embodiment of the tool of the invention.
Figure 6:
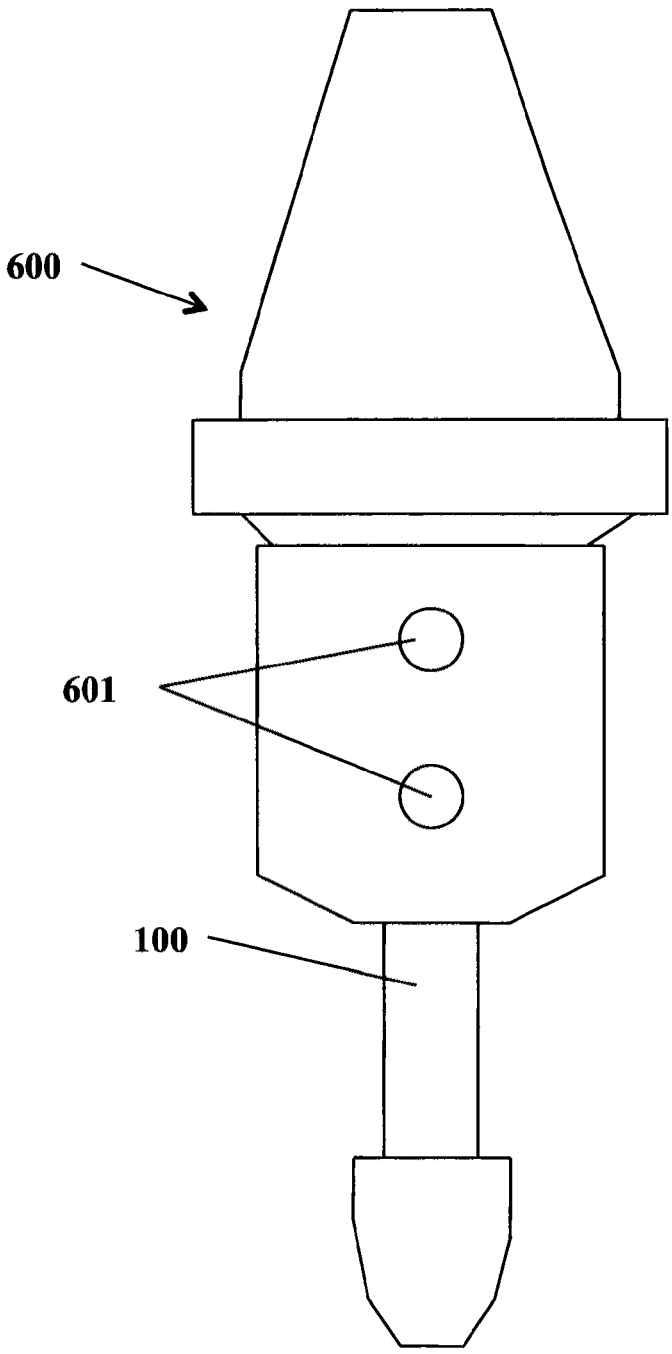
FIG. 6 illustrates the tool of FIG. 1 mounted in a spindle of a machine.

FIG. 1 illustrates one embodiment of a tool 100 in accordance with the principles of the invention. Tool 100 comprises a first tubular member or outer tube 101. Outer tube 101 is of cylindrical shape. In other embodiments, outer tube 101 may be of a different shape. One end 101*a* of outer tube 101 is closed by a surface 115*a*. Surface 115*a* may be provided by an end cap 115 as shown in FIGS. 1 - 4, or by a surface carried by the machine into which tool 100 is used as shown in FIG. 6.

The other end 101*b* of outer tube 101 has integrally formed thereon a radially inward extending flange or lip 103 that carries a first guide surface 103*a*. The inner wall 101*c* of outer tube 101 provides a second guide surface 101*d*.

A second tubular member or inner tube 105 is disposed partially within and telescopically extending from outer tube 101. The end 105*a* of inner tube 105 disposed within outer tube 101 has a radially outward extending flange or lip 107. Lip 107 carries a first guide surface 107*a*. First guide surface 107*a* slideably engages second guide surface 101*d* of outer tube 101. The outer wall 105*b* of inner tube 105 provides a guide surface 105*c*. Guide surface 105*c* slideably engages second guide surface 103*a* 101*d* of outer tube 101.

A first resilient member or device or spring 111 is disposed within outer tube 101. One end of spring 111 engages surface 115. The other end of spring 111 engages the top surface 105*d* of inner tube 105. Spring 111 is selected such that inner tube 105 extends outside of outer tube 101 a predetermined distance as shown in FIG. 1.

The other end 105*e* of inner tube 105 carries a tapered outer collar 119 of a chuck or collet assembly 131. Collar 119 may be affixed to inner tube 105 by any one of a number of conventional means. In the embodiment shown in the drawing figures collar 119 has a threaded portion 119*a* carrying threads that engage mating threads carried by inner tube 105.

A tubular material holder or tubular marking lead or working tool or third tubular member or implement holder or tubular tool holder 123 is telescopically disposed within inner tube 105. Implement holder 123 includes a collet 121. Implement holder 123 includes a lip 123*a* that forms a guide surface 123*b*.

The inner surface 105*f* of inner tube 105 includes a guide surface 105*g*. Guide surface 105*g* is slidingly engaged by guide surface 123*b* of implement holder 123.

A second resilient member or spring 127 is disposed within inner tube 105. One end of spring 127 engages an annular surface 119*b* carried on the inside of collar 119. The other end of spring 127 engages a surface 123*c* of holder 123. Spring 127 is selected such that it urges implement holder 123 into inner tube 105.

Figure 5:
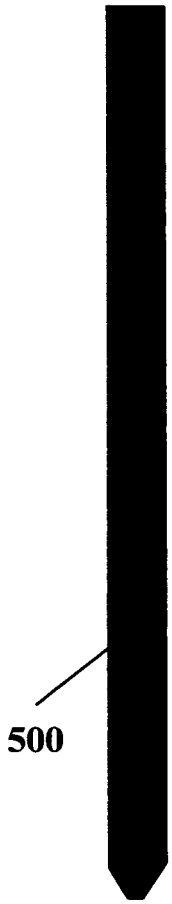
FIG. 5 shows an insert of marking material.

In the embodiment shown, an insert 500 of a marking material such as that shown in FIG. 5 is utilized to mark trim lines. It has been determined that use of graphite marking material is particularly advantageous on the polymer plastic material that is utilized in the Doc Band®.

Figure 2:
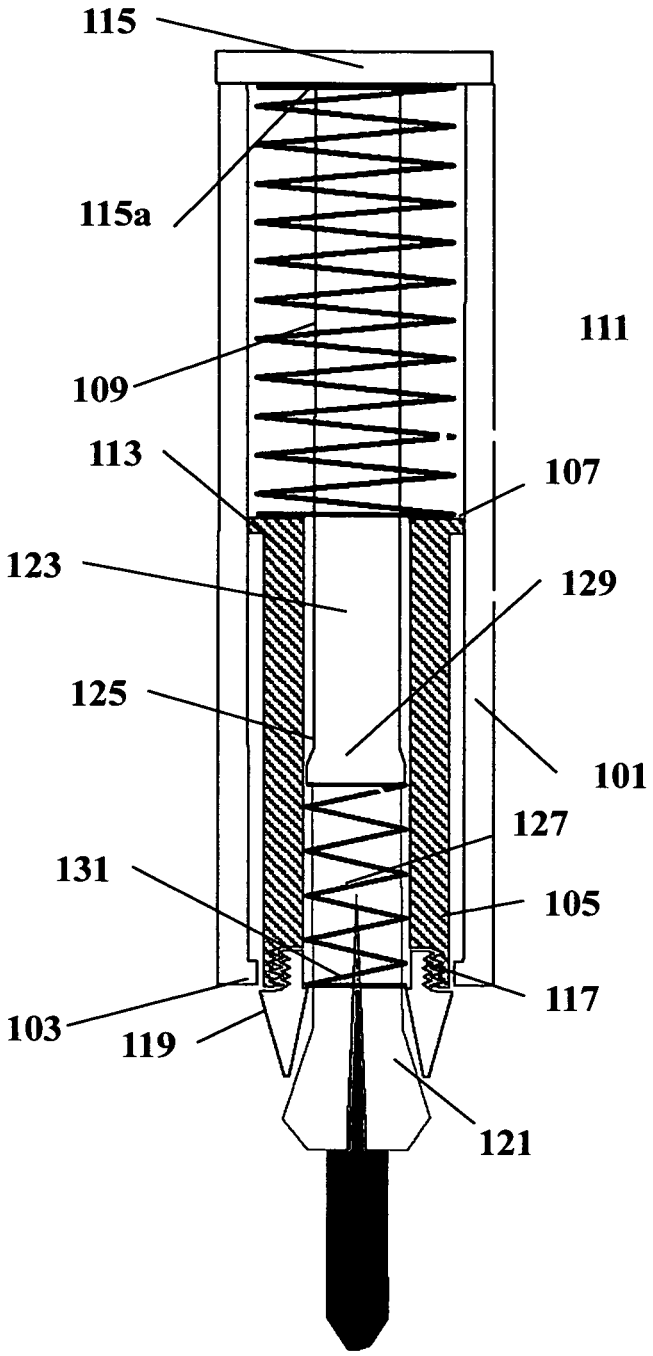
FIG. 2 illustrates the tool of FIG. 1 in a first operational state.

To install insert 500 into tool 100, collar 119 is pushed such that inner tube 105 is fully inserted into outer tube 101. Spring 127 carries the top of holder 123 into engagement with surface 115. As first sloped surface of collet 121 disengages second sloped surface of collar 119 it spreads or opens such that insert 500 may be installed into holder 123 as shown in FIG. 2.

Releasing collar 119 results in spring 127 urging holder 123 away from collar 119. In this position, collet 121 firmly grips insert 500 and retains it in tool 100. In addition, spring 111 urges inner tube away from surface 115 such that tool 100 and insert 500 are in the position shown in FIG. 3

Figure 3:
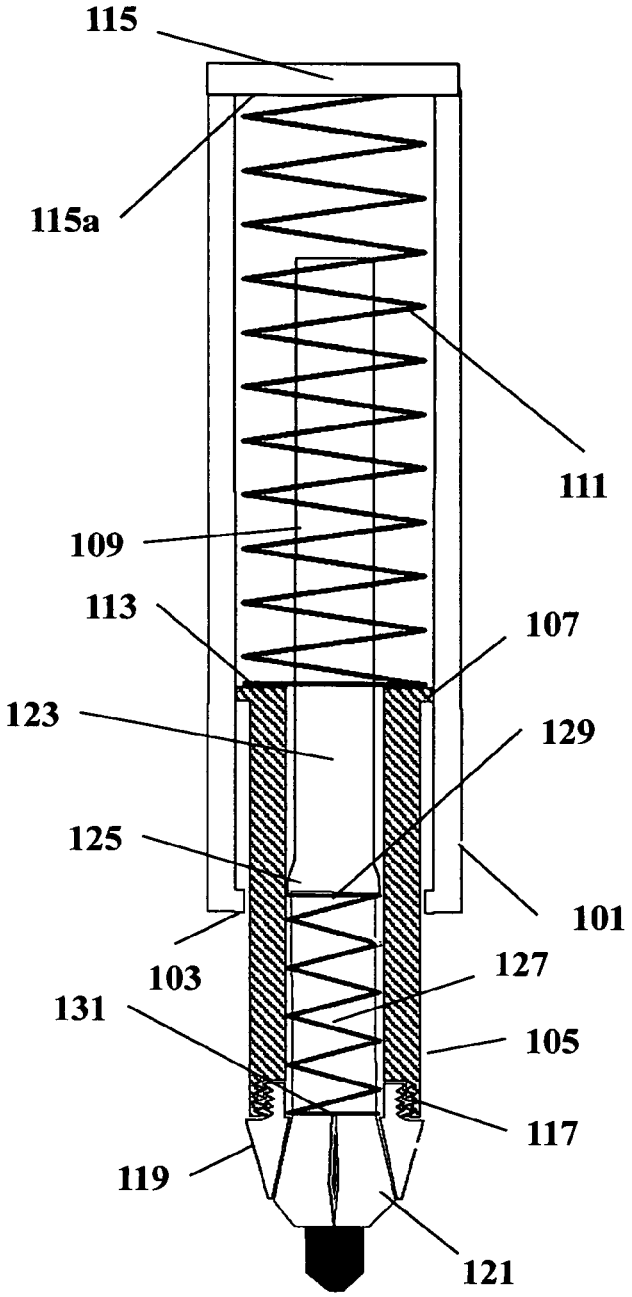
FIG. 3 illustrates the tool of FIG. 1 in a second operational state.
Figure 4:
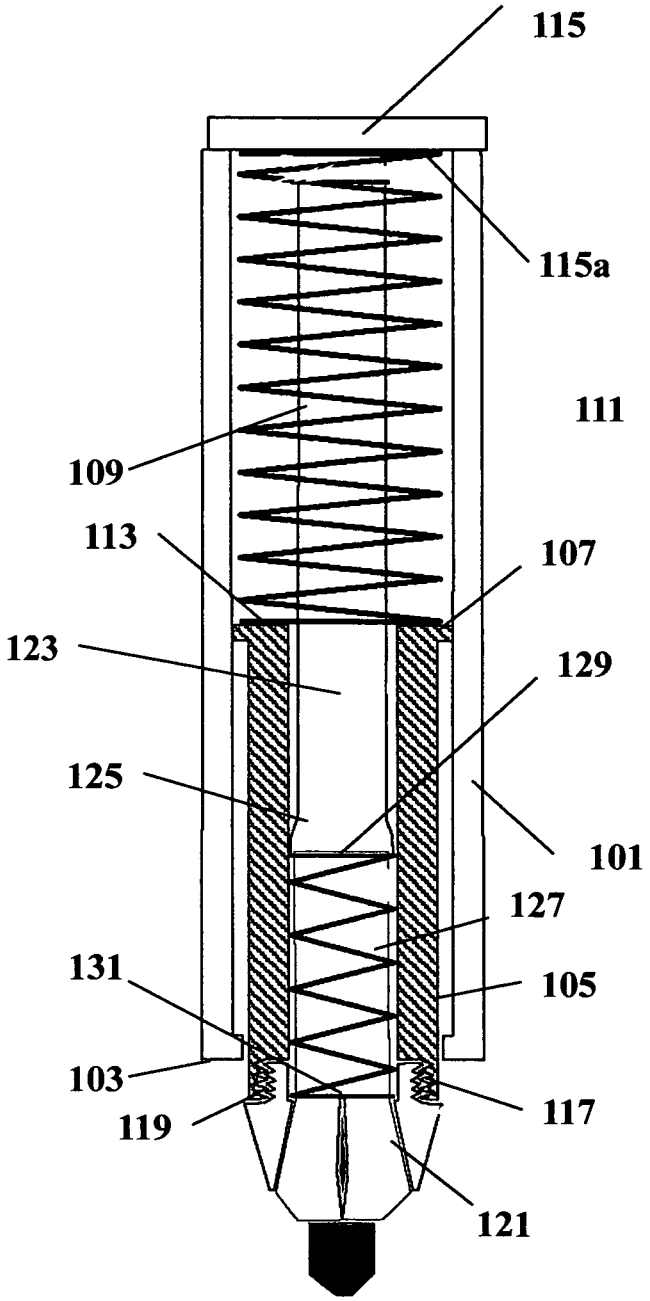
FIG. 4 illustrates the tool of FIG. 1 in a third operational state.

With spring 111, tool 100 may operate in a range of positions from a first position shown in FIG. 3 to a second position as shown in FIG. 4.

Turning now to FIG. 6 tool 100 is inserted into a spindle 600 of a machine that is not shown. Tool 100 is affixed to spindle 600 by setscrews 601. It will be appreciated by those skilled in the art that other approaches may be used to affix tool 100 to the spindle of a machine.

In an embodiment of the invention spindle 600 is that of a commercially available 5-axis computerized numeric control (CNC) machine that can mill a piece stock over three dimensions. The specific machine utilized is a 5-axis commercially available vertical mill that can mill three-dimensional objects with appropriate milling tools.

The assignee of the present invention utilizes the machine to mill a full size model of a desired head shape utilizing computer generated data regarding a desired head shape as described in the patents incorporated herein by reference above. After forming the desired head shape, plastic material is formed onto the head shape. The plastic material must be trimmed by cutting along trim lines to form the desired cranial remodeling device.

The system described in the referenced patents automatically generates trim lines for each custom cranial remodeling device. Tool 100 permits a milling tool in a CNC machine to be replaced with a marking tool that can draw trim lines rather than cut trim lines. The advantage of drawing the trim lines onto the three-dimensional surface rather than cutting trim lines allows for manual adjustments to be made prior to the cutting.

Tool 100 advantageously includes a spring biased mechanism that urges the insert 500 of marking material into engagement with a surface, and when it is in contact with a surface the spring bias permits the insert 500 to rise if the surface "rises" underneath it.

Most printers, plotters and other devices are designed to handle surface in two-dimensions only. Tool 100 can "write" or mark on three-dimensional surfaces. This has the additional advantage of compensating for small deviations or errors in how tool 100 is touched off or "zeroed". Spring loading allows for small errors.

Tool 100 accommodates different surfaces, such as flat, round, elliptical, rough, smooth, etc. Regardless of the surface spring loading makes tool 100 adaptable to the surface terrain.

Although the embodiment describes a marking lead material, other marking materials may be utilized in tool 100. Graphite, marking lead, wax, grease, China marker, adhesive, glue, marker, masking material, paint, and fluorescent die are merely representative of the type of material that may be deposited onto a surface utilizing tool 100. The marking can be either permanent or cleanable or erasable depending on the specific application. In one application, wax could be deposited onto a surface to protect the waxed over portion during an etch operation.

By rotating tool 100 at a slow rate while it is in the spindle, the tip of the insert 500 can be kept sharp.

Although the embodiment of tool 100 shown an described above requires that the insert 500 be manually advanced, it will be apparent to those skilled in the art that an automatic self-feed utilizing an additional pressure based resilient mechanism may be utilized.

Although tool 100 has been described with respect to depositing material onto a surface, it should be further apparent to those skilled in the art that a cutting tool bit may also be used in tool 100 in place of insert 500. The use of tool 100 with a cutting tool insert has certain advantages. The spring loading of tool 100 can save a work pieces from being damaged in the event of a programming error that would otherwise result in the cutting tool from smashing into the surface of the work piece resulting in destruction or damage to the work piece and/or the tool.

In another embodiment of the invention, a sensor could be provided in tool 100 to detect a travel limit of inner tube 105 and/or of holder 123. The sensor could provide a signal to the machine to stop operation or cause another response to, for example, stop operation of the machine to avoid tool breakage.

One particular advantage of tool 100 is that it can simplify programming operation of the machine. By way of example, if it is desired to draw a line across a surface that has rises and dips such as a saw tooth, the line could simply be plotted and the spring loading of tool 100 would follow the surface. Otherwise, it would be necessary to program a more complex line with more accelerations/decelerations—a slower, more inefficient process and tougher on the mill.

The invention has been described in terms of various embodiments. It will be apparent to those skilled in the art that various changes and modifications may be made to the embodiments shown and described without departing from the spirit or scope of the invention. It is intended that the embodiments shown and described are illustrative of the principles of the invention and that the invention not be limited to such embodiments. It is intended that the invention be limited in scope only by the claims appended hereto, with the claims being given the broadest scope permissible under the relevant law.

What is claimed is:

1. A tool for depositing material onto a three-dimensional surface, said tool comprising:

a first tubular member adapted to be carried by a spindle of a machine operable to move said spindle over a three-dimensional surface, said first tubular member comprising a first guide surface and a second guide surface;

a second tubular member comprising a first guide surface engaging said first tubular member second guide surface and comprising a second guide surface engaging said first tubular member first guide surface;

a first resilient member disposed to urge said second tubular member in a first axial direction relative to said first tubular member;

a material holder carried by said second tubular member and adapted to carry said material extending therefrom in said first axial direction; and a second resilient member disposed to urge said holder into engagement with said second tubular member;

said first tubular member and said second tubular member cooperating with said first resilient member to resiliently urge said material holder in said first axial direction such that when said material holder is proximate said three-dimensional surface, said material holder adapted to resiliently urge said material extending therefrom against said three-dimensional surface to thereby deposit said material onto said three-dimensional surface.

2. A tool in accordance with claim 1, wherein:

said first resilient member comprises a spring engaging said second tubular member and a fixed surface.

3. A tool in accordance with claim 2, wherein:

said second resilient member comprises a spring.

4. A tool in accordance with claim 1, wherein:

said material holder comprises a collet having a first sloped surface and a collar carried by said second tubular member, said collar having a second sloped surface adapted to releasably engage said first sloped surface.

5. A tool in accordance with claim 4, wherein:

said second resilient member urges said collet first surface into engagement with said collar second surface to retain material in said tool.

6. A tool in accordance with claim 5, wherein:

said material is selected from the group comprising: graphite, marking lead, wax, grease, China marker, adhesive, glue, marker, masking material, paint, and fluorescent die.

7. A tool in accordance with claim 1, wherein:

said material holder carries a material selected from the group comprising: graphite, marking lead, wax, grease, China marker, adhesive, glue, marker, masking material, paint, and fluorescent die.

8. A tool in accordance with claim 1, comprising:

a radially inward extending flange carried on said first tubular member, said radially inward extending flange comprising said first tubular member said first guide surface; and a radially outward extending flange carried on said second tubular member, said radially outward extending flange carrying said second tubular member first surface.

9. A tool in accordance with claim 8, wherein:

said first tubular member comprises an inner wall, said inner wall of said first tubular member carries said first tubular member second surface; and said second tubular member comprises an outer wall, said outer wall of said second tubular member carries said second tubular member second surface.

10. A tool in accordance with claim 9, wherein:

said material holder comprises: a collar carried by said second tubular member, said collar having a first sloped surface; and a collet having a second sloped surface adapted to releasably engage said first sloped surface.

11. A tool in accordance with claim 9, wherein:

said material holder comprises a third tubular member extending from said collet, said third tubular member comprising a first engagement surface engaging said second resilient member; and wherein said second tubular member comprises a second engagement surface engaging said second resilient member;

said first and second engagement surfaces and said second resilient member cooperatively operating to urge said collet second sloped surface into engagement with said collar first sloped surface.

12. Apparatus for holding a tool to work a three-dimensional surface, said apparatus comprising:

a first tubular member adapted to be carried by a spindle of a machine operable to move said spindle over a three-dimensional surface, said first tubular member comprising a first guide surface and a second guide surface;

a second tubular member comprising a first guide surface engaging said first tubular member second guide surface and comprising a second guide surface engaging said first tubular member first guide surface;

a first resilient member disposed to urge said second tubular member in a first axial direction relative to said first tubular member;

a tool holder carried by said second tubular member and adapted to hold said tool such that said tool extends from said tool holder; and a second resilient member disposed to urge said tool holder into engagement with said second tubular member;

said first tubular member and said second tubular member cooperating with said first resilient member to resiliently urge said tool holder in said first axial direction, said tool holder adapted to carry said tool into resilient engagement with said three-dimensional surface when said spindle is proximate to said three-dimensional surface.

13. Apparatus in accordance with claim 12, wherein:

said first resilient member comprises a spring engaging said second tubular member and a fixed surface.

14. Apparatus in accordance with claim 13, wherein:

said second resilient member comprises a spring.

15. Apparatus in accordance with claim 12, wherein:

said tool holder comprises a collet having a first sloped surface and a collar carried by said second tubular member, said collar having a second sloped surface adapted to releasably engage said first sloped surface.

16. Apparatus in accordance with claim 15, wherein:

said second resilient member urges said collet first surface into engagement with said collar second surface to retain a tool in said tool holder.

17. Apparatus in accordance with claim 12, comprising:

a radially inward extending flange carried on said first tubular member, said radially inward extending flange comprising said first tubular member first guide surface; and a radially outward extending flange carried on said second tubular member, said radially outward extending flange carrying said second tubular member first guide surface.

18. Apparatus in accordance with claim 17, wherein:

the inner wall of said first tubular member carries said first tubular member second surface; and the outer wall or said second tubular member carries said second tubular member second surface.

19. Apparatus in accordance with claim 18, wherein:

said tool holder comprises: a collar carried by said second tubular member, said collar having a first sloped surface; and a collet having a second sloped surface adapted to releasably engage said first sloped surface.

20. A tool for depositing material onto a three-dimensional surface to mark trim lines for a cranial remodeling device, said tool comprising:

a first tubular member adapted to be carried by a spindle of a machine operable to move said spindle over a three-dimensional surface, said first tubular member comprising a first guide surface and a second guide surface;

a second tubular member comprising a first guide surface engaging said first tubular member second guide surface and comprising a second guide surface engaging said first tubular member first guide surface;

a first resilient member disposed to urge said second tubular member in a first axial direction relative to said first tubular member;

a material holder carried by said second tubular member and adapted to carry said material; and a second resilient member disposed to urge said material holder into engagement with said second tubular member;

said first tubular member and said second tubular member cooperating with said first resilient member to urge said material holder in said first axial direction, said material holder adapted to carry said material into resilient engagement with said three-dimensional surface when said spindle is proximate said three-dimensional surface.

21. Apparatus in accordance with claim 20, wherein:

said first resilient member comprises a spring engaging said second tubular member and a fixed surface.

22. Apparatus in accordance with claim 21, wherein:

said second resilient member comprises a spring.

23. Apparatus in accordance with claim 22, wherein:

said material holder comprises a collet having a first sloped surface and a collar carried by said second tubular member, said collar having a second sloped surface adapted to releasably engage said first sloped surface.

24. Apparatus in accordance with claim 23, wherein:

said second resilient member urges said collet first surface into engagement with said collar second surface to retain material in said material holder.

25. Apparatus in accordance with claim 24, comprising:

a radially inward extending flange carried on said first tubular member, said radially inward extending flange comprising said first tubular member first guide surface; and a radially outward extending flange carried on said second tubular member, said radially outward extending flange carrying said second tubular member first guide surface.

26. Apparatus tool in accordance with claim 25, wherein:

the inner wall of said first tubular member carries said first tubular member second surface; and the outer wall or said second tubular member carries said second tubular member second surface.

* * * * *